US007641143B2

(12) United States Patent
Omdoll et al.

(10) Patent No.: US 7,641,143 B2
(45) Date of Patent: Jan. 5, 2010

(54) WEB MATERIAL DISPENSER

(75) Inventors: Paul A. Omdoll, Waukesha, WI (US); Michael Young, Mukwonago, WI (US)

(73) Assignee: The Colman Group, Inc., Elkhorn, WI (US)

( * ) Notice: Subject to any disclaimer, the term of this patent is extended or adjusted under 35 U.S.C. 154(b) by 0 days.

(21) Appl. No.: 11/839,231

(22) Filed: Aug. 15, 2007

(65) Prior Publication Data

US 2008/0042006 A1 Feb. 21, 2008

Related U.S. Application Data

(60) Provisional application No. 60/837,780, filed on Aug. 15, 2006.

(51) Int. Cl.
*B65H 16/04* (2006.01)

(52) U.S. Cl. ..... 242/597.8; 242/560

(58) Field of Classification Search ..... 242/597, 242/597.1, 597.5, 597.8, 598.5, 560; D6/518–523
See application file for complete search history.

(56) References Cited

U.S. PATENT DOCUMENTS 1,415,722 A * 5/1922 Silverman
2,994,488 A * 8/1961 Waddell ..... 242/597.5
3,620,465 A * 11/1971 Wyatt et al.
5,058,792 A * 10/1991 Morand
5,172,840 A * 12/1992 Bloch et al.
D357,150 S * 4/1995 Morand ..... D6/520
5,833,169 A * 11/1998 Morand ..... 242/597.8
5,996,931 A * 12/1999 Neveu et al. ..... 242/597.8
6,758,434 B2 * 7/2004 Kapiloff et al. ..... 242/597.8

OTHER PUBLICATIONS

Notification of Transmittal of The International Search Report and The Written Opinion of the International Searching Authority, or the Declaration mailed Dec. 12, 2008.
International Preliminary Report on Patentability with Opinion of International Searching Authority.

* cited by examiner

*Primary Examiner*—William A Rivera
(74) *Attorney, Agent, or Firm*—Boyle Fredrickson, S.C.

(57) ABSTRACT

A web dispenser comprising a housing for holding at least one roll of web material therein. A mandrel connects to the housing for maintaining at least one roll of web material thereon and facilitating the rotation of the roll of web material to dispense the web material from the roll. A mounting block is affixed to the housing for mounting the housing to a wall at an acute angle relative to the wall. This results in the ergonomic presentation of web material to a stationary user.

9 Claims, 8 Drawing Sheets

WEB MATERIAL DISPENSER

This application claims priority to U.S. provisional application Ser. No. 60/837,780, filed Aug. 15, 2006, the entire contents of which is incorporated herein by reference.

FIELD OF THE INVENTION

The present invention relates to a dispenser for dispensing rolls of flexible sheet material, such as toilet tissue. More particularly, this invention relates to a dispenser for dispensing flexible sheet material which presents the flexible sheet material to a user in an ergonomic manner.

BACKGROUND OF THE INVENTION

In institutional and public restrooms, toilet tissue is maintained in some form of dispenser. Traditionally, such tissue is in the form of a standard roll measuring 4 to 6 inches in diameter. Such rolls are generally mounted on the wall of a bathroom stall adjacent a commode to facilitate ease of use by a person occupying the stall.

However, more recently, in an effort to minimize service requirements, toilet tissue has also been provided in a large "jumbo-sized" roll. Jumbo-sized rolls are typically seven to thirteen inches in diameter, as opposed to the traditional-sized rolls which are four to six inches in diameter. Thus, the jumbo-sized rolls can hold about five to twelve times the amount of tissue as the traditional-sized rolls. These jumbo-sized rolls have necessitated much larger dispensers to accommodate them. As an alternative to jumbo-sized rolls, large multiple roll dispensers have been created to store and dispense multiple standard sized toilet tissue rolls. These dispensers are often as large as or larger than the dispensers designed to accommodate jumbo-sized rolls.

At the same time as the size of dispensers has been increasing, the size of bathroom stalls has been shrinking to maximize the number of units provided in limited space. This has created space and dispensing issues within the stall. In addition to taking up much of the limited space in the stall, these large sized dispensers are designed so that the axis of rotation of the roll is perpendicular to the restroom wall. This makes it annoying and difficult to withdraw tissue paper. For example, when a new jumbo-sized roll is installed in the dispenser, it is difficult to withdraw tissue paper because full and substantially full jumbo-sized rolls are heavy, and a large force must be applied by pulling the free end or tail of the roll, to rotate the roll. This can be particularly challenging because the user is generally located in the center of the stall such that pulling the paper toward the user's position is unnatural and can undesirably fold or tear the paper. Still further, where the stall includes rails to accommodate handicapped users, the dispenser must either be mounted very high or very low, or the paper dispensed through the rails.

When traditional sized rolls of toilet tissue are employed they too are often angled away from a user depending on their mounting location. As is well known, traditional toilet tissue dispensers dispensing traditional sized rolls of toilet tissue are mounted so that the toilet tissue is dispensed at 90° to the wall on which the dispenser is mounted. If the dispenser is not mounted right next to the user, the paper can end up undesirably folded or torn in a manner similar to that which occurs when a jumbo-sized roll is used and mounted along the wall.

SUMMARY OF THE INVENTION

In view of the foregoing, the present invention is directed to an improved dispenser for rolled sheet material that presents the paper to a user in an ergonomic and natural way that minimizes the likelihood of unwanted folding and tearing of the sheet material.

In one embodiment of the present invention, a dispenser for dispensing flexible sheet material from jumbo-sized rolls is provided. The dispenser comprises an angled mounting block that is used to mount the dispenser along a wall such that the dispenser housing is angled relative to the wall. This construction permits the dispenser to be mounted slightly out in front of a commode to ease space concerns and yet permit the flexible sheet material to be dispensed directly toward a user in a natural manner without undesirable folding or tearing. This is accomplished while minimizing the protrusion of the dispenser from the wall so as not to impede access to the facilities within the allotted space. Preferably the mounting block and the dispenser housing are configured such that they can by rotated relative to each other to permit the dispenser of the present invention to be mounted on any parallel wall while still maintaining the desired sheet presentation.

In a second embodiment of the present invention, a dispenser for dispensing flexible sheet material from traditional sized toilet paper rolls is provided. As with the jumbo roll embodiment, the dispenser comprises an angled mounting block that is used to mount the dispenser along a wall such that the dispenser housing is angled relative to the wall. Preferably the mounting block and the dispenser housing are configured such that they can by rotated relative to each other to permit the dispenser of the present invention to be mounted on any parallel wall while still maintaining the desired sheet presentation.

DETAILED DESCRIPTION

As shown in FIGS. 1-8, in one embodiment of the present invention 10, a housing 12 is fitted on an angled mounting block 14. The housing 12 is sized to accommodate at least one roll of web material to be mounted on a mandrel 22 (see FIG. 9).

Figure 8:
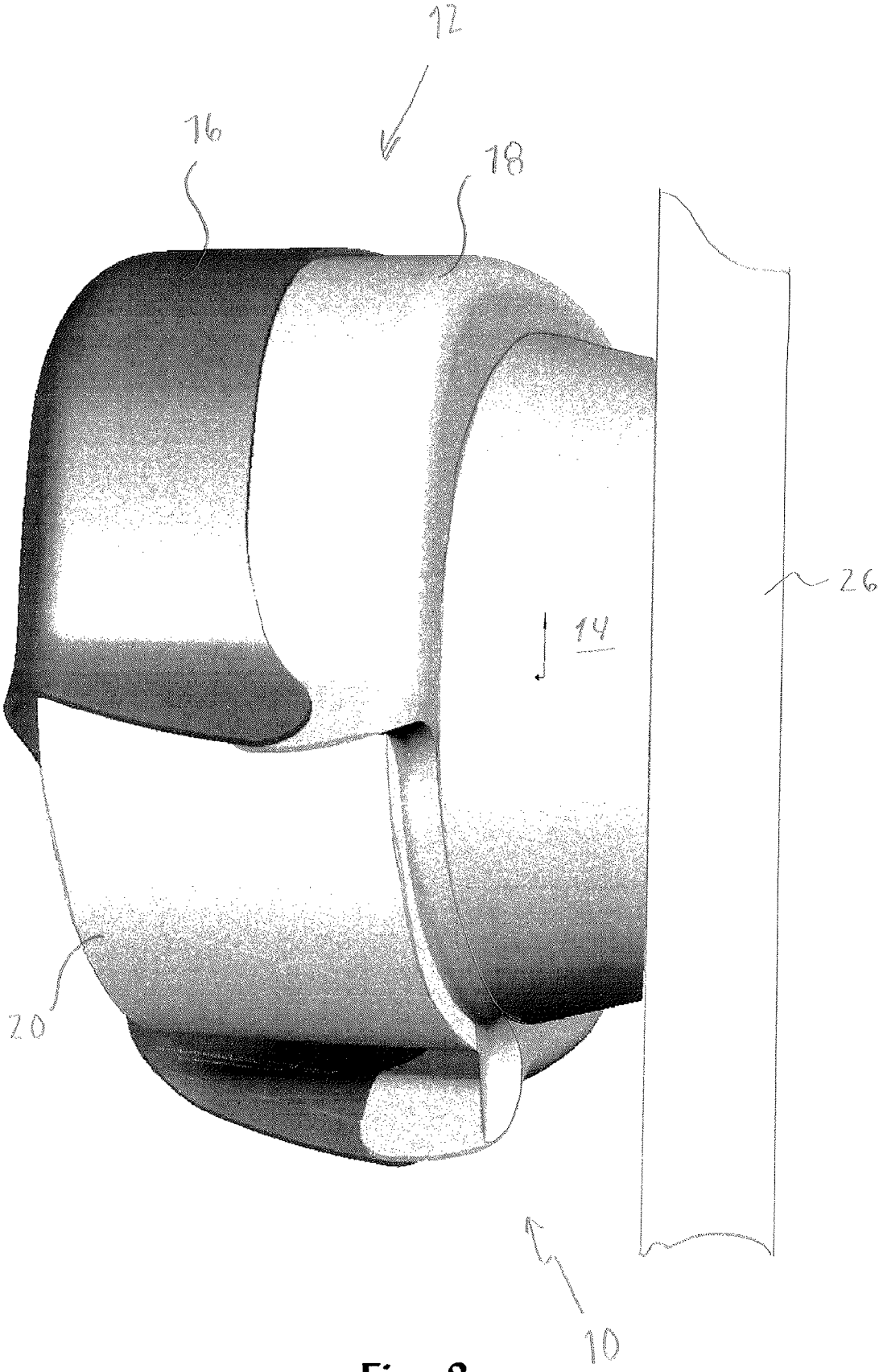
FIG. 8 is a front view of one embodiment of the present invention as it would appear if mounted on a wall.

As shown in FIG. 8, the angled mounting block 14 is designed to be mounted on a wall 26. Preferably, but not necessarily, the mounting block 14 is separable from housing 12 so that it can be mounted independently on a wall 26. The mounting block 14 can be rotated 180° for mounting on either side wall of an enclosure, so that the presentation of web material from the housing 12 to an end user is substantially the same.

Figure 1:
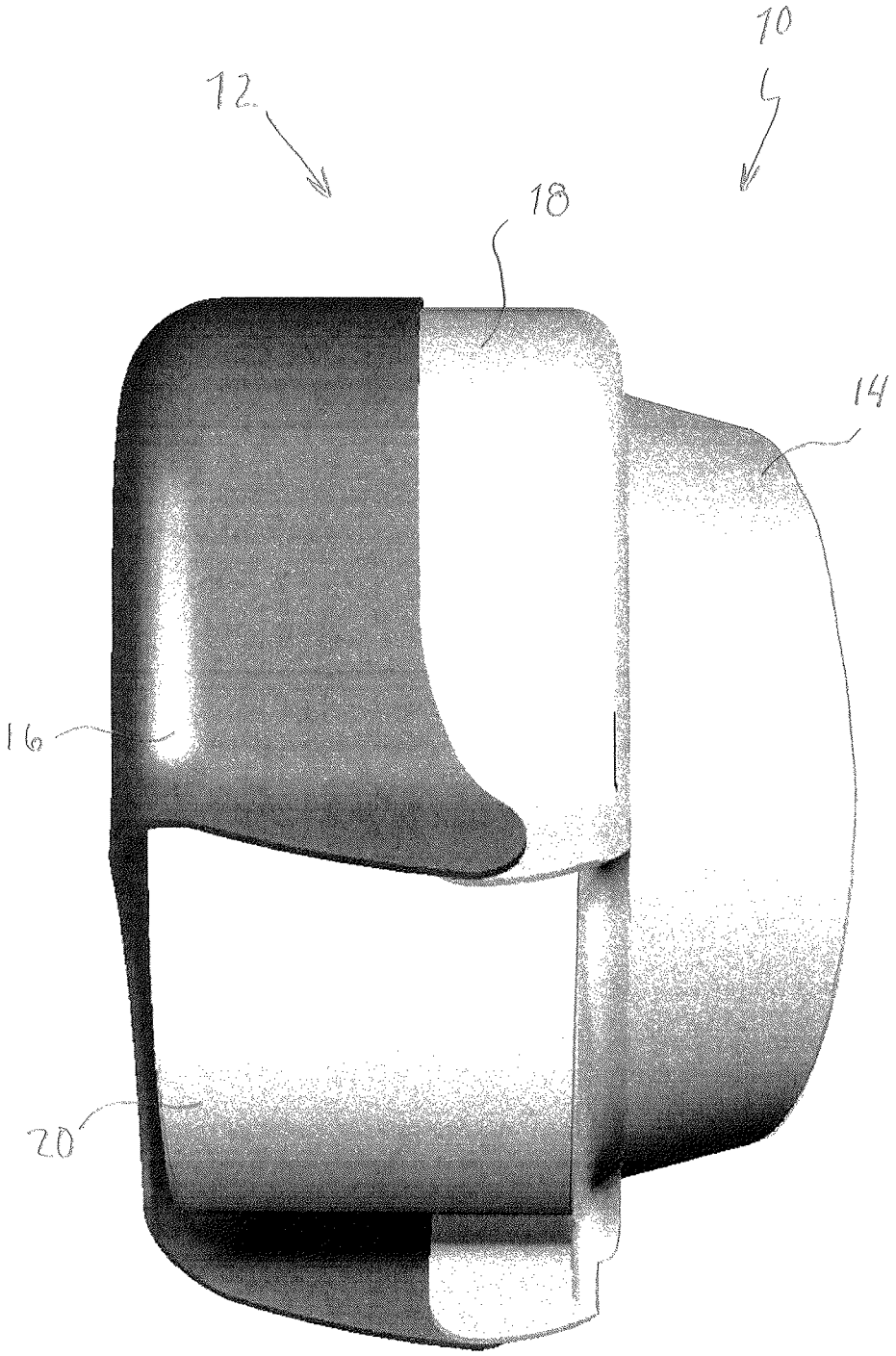
FIG. 1 is a front view of one embodiment of the present invention.
Figure 2:
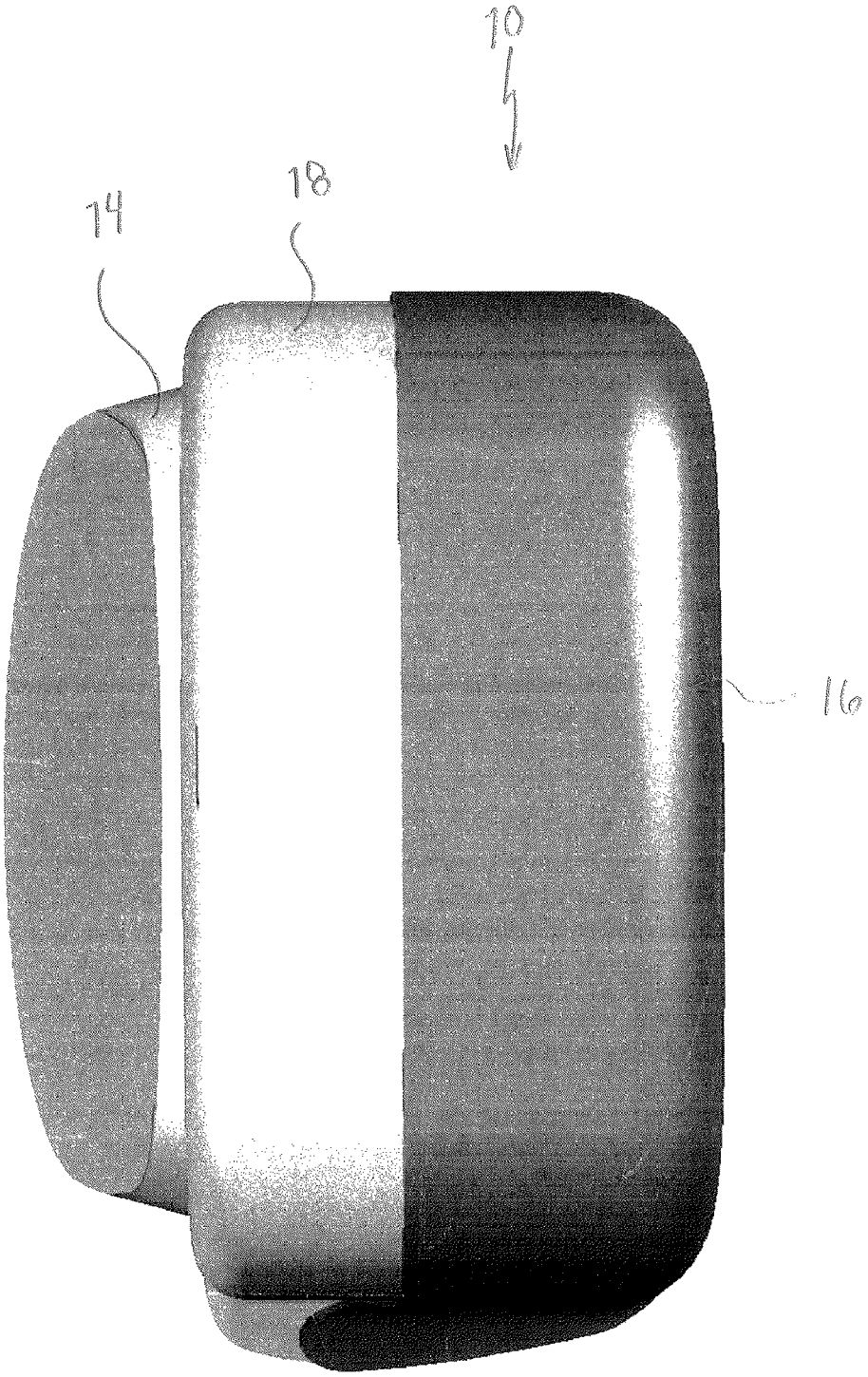
FIG. 2 is a back view of one embodiment of the present invention.
Figure 3:
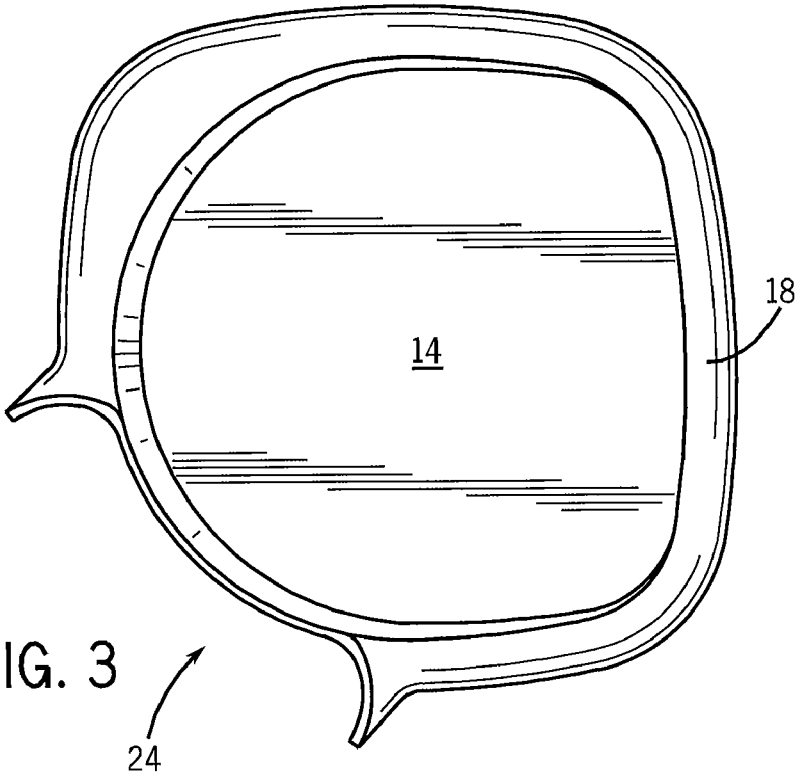
FIG. 3 is a left side view of one embodiment of the present invention.
Figure 4:
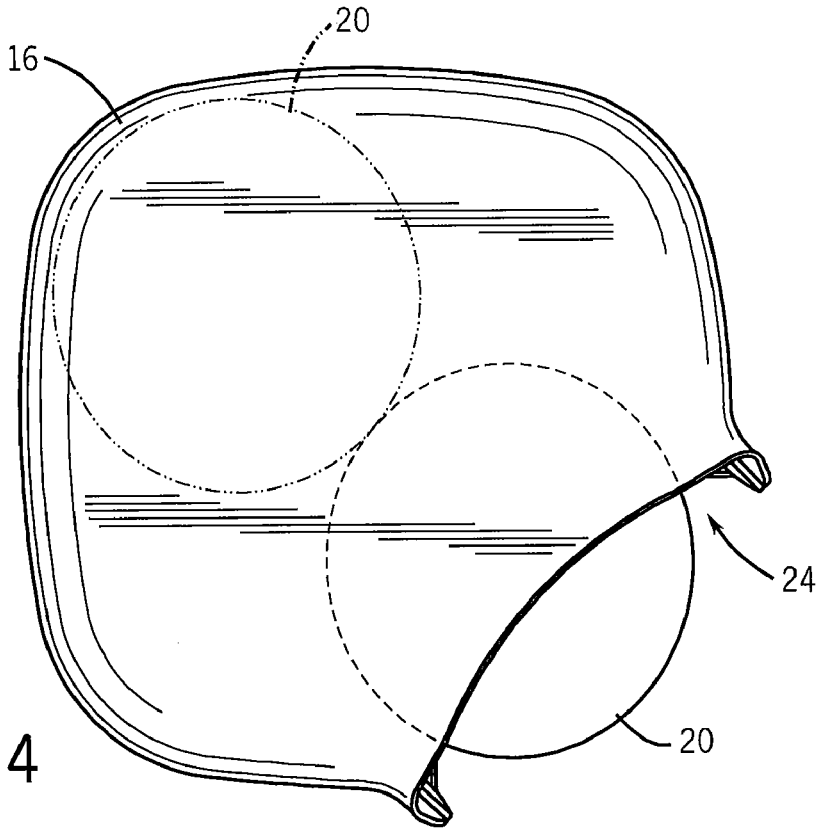
FIG. 4 is a right side view of one embodiment of the present invention.
Figure 5:
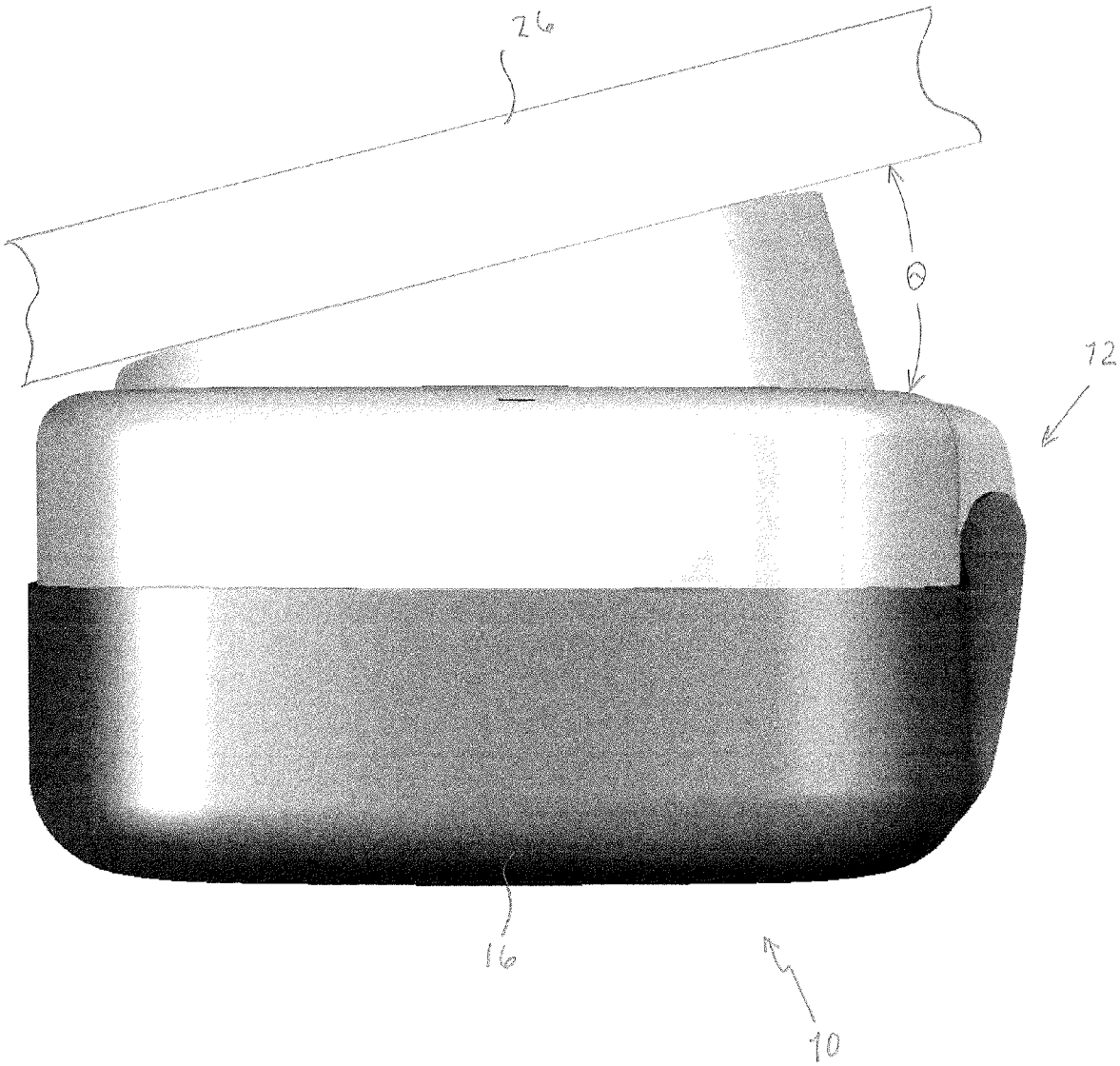
FIG. 5 is a top view of one embodiment of the present invention.
Figure 6:
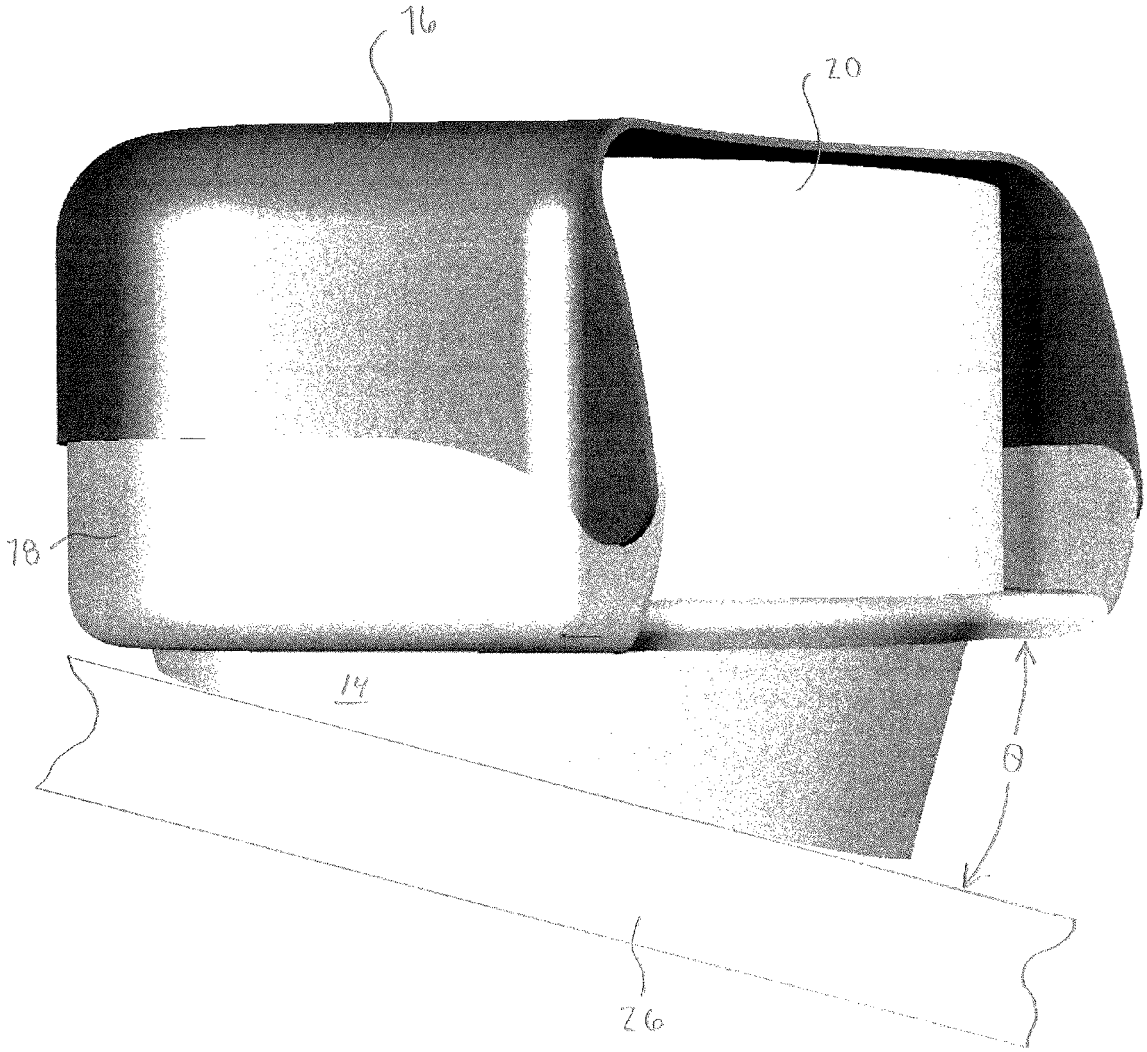
FIG. 6 is a bottom view of one embodiment of the present invention.
Figure 7:
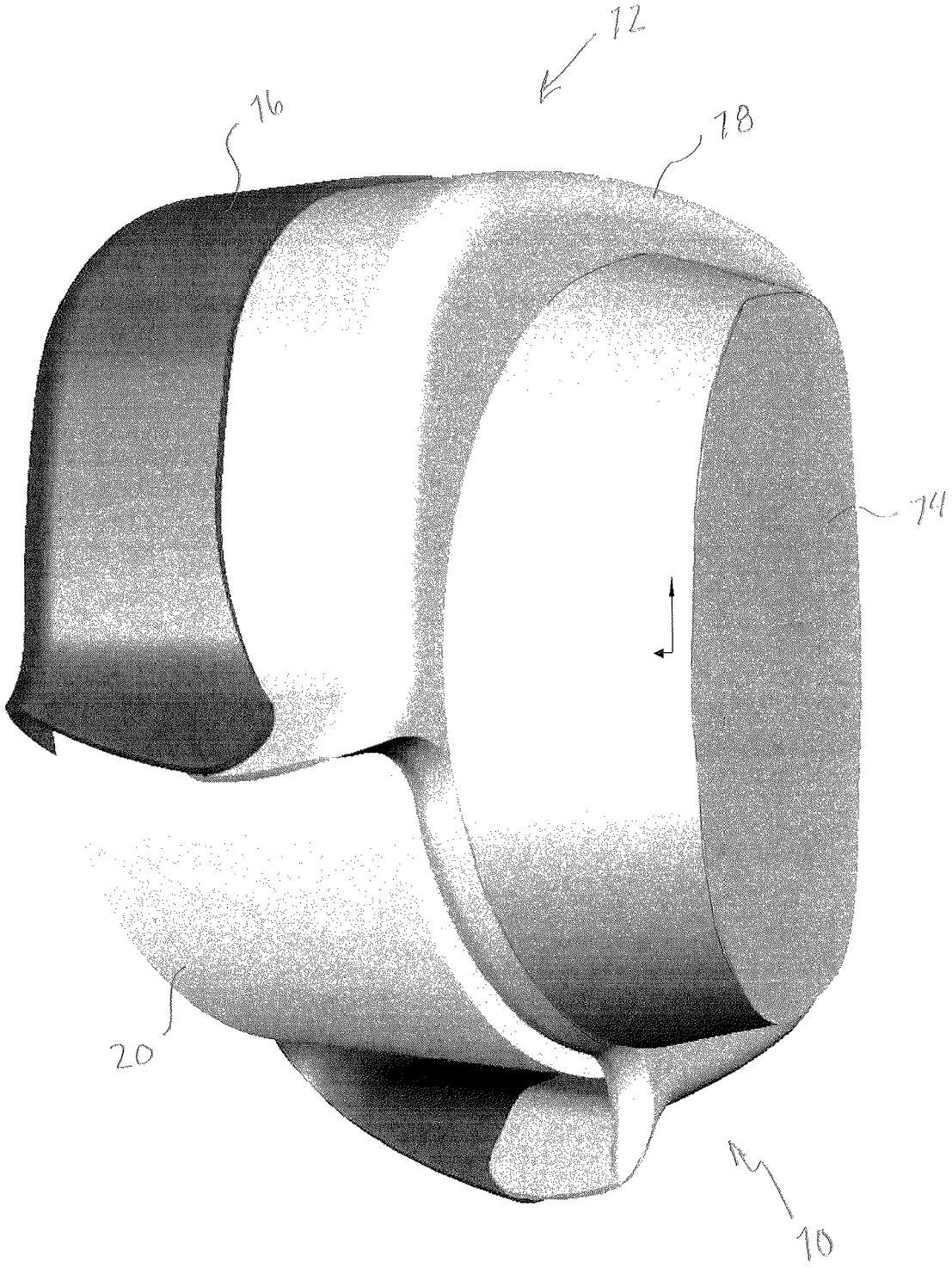
FIG. 7 is a front perspective view of one embodiment of the present invention.

As shown in FIGS. 5 and 6, mounting block 14 is wedge shaped and preferably defines an angle θ between 5° and 85°. More preferably the angle θ is between 6° and 45° and most preferably between 10° and 15°. The smaller the defined angle, the less the space is taken up by the dispenser 10 when it is mounted on a wall 26. However, greater angles may be more desirable for proper presentment of the contained web material to a user.

The housing 12, is preferably in two pieces with the first inner housing piece 18 capable of being selectively mounted on mounting block 14. Inner housing piece 18 is configured to attach to mounting block 14 in multiple positions so that it can be properly positioned for proper web material presentation regardless of which sidewall to which mounting block 14 is attached. Alternatively, inner housing piece 18 can be rotatably attached to mounting block 14 such that it can be rotated into a desired position and then locked in place. Preferably the pieces rotate relative to each other between 45 and 180 degrees.

An external housing piece 16 cooperatively engages inner housing piece 18 to complete and define the housing 12. It is selectively removable in order to place a roll of web material 20 into position on a supporting mandrel 22. The housing 12 has an opening 24 for egress of the contained web material 20. If the web material 20 to be used in the dispenser 10 is not perforated, a cutting blade, not shown, is juxtaposed relative to the opening 24 to facilitate tearing of the web material.

Figure 9:
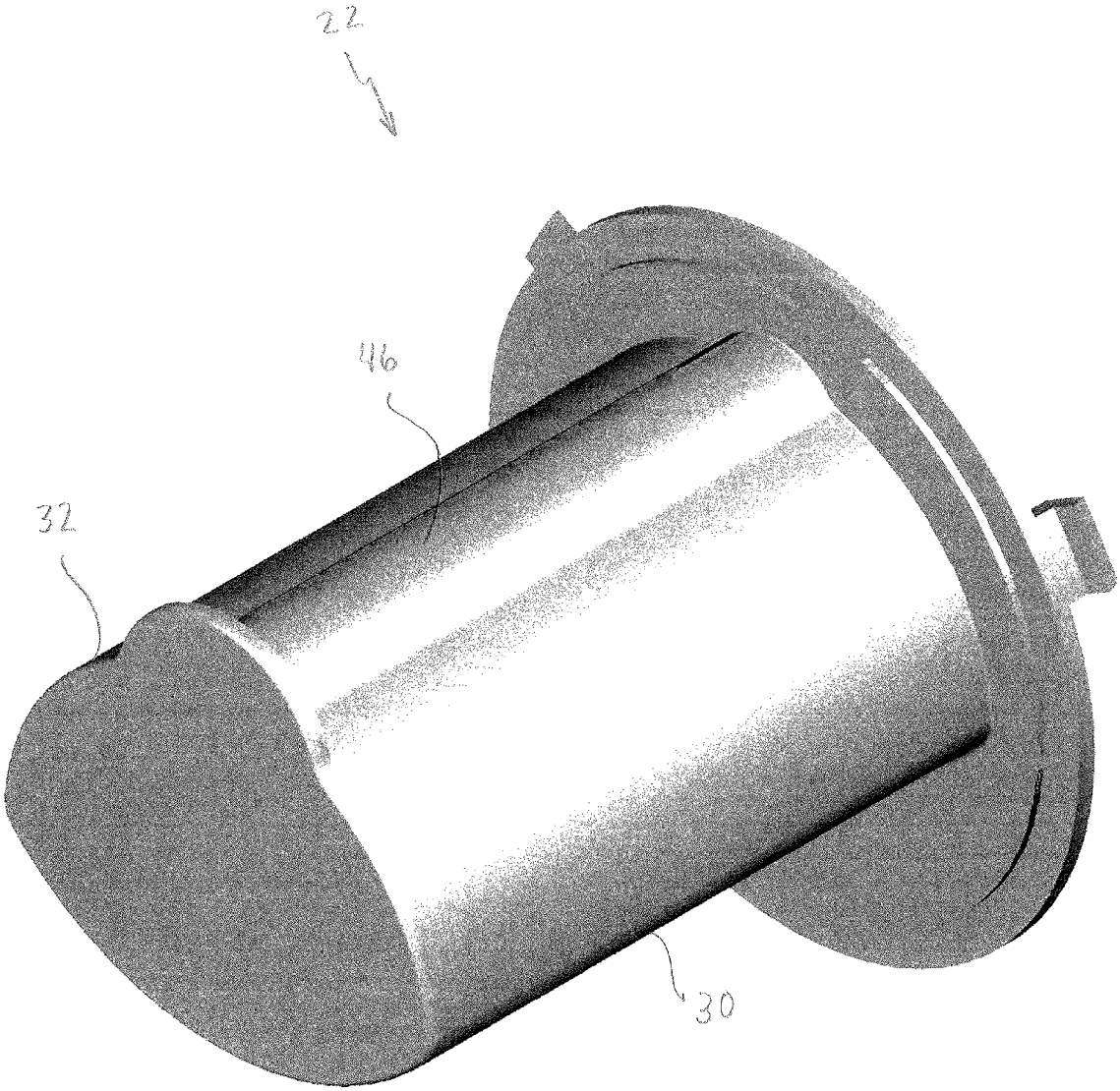
FIG. 9 is a perspective view of one embodiment of a mandrel to be used in conjunction with the present invention.

As shown in FIG. 9, the mandrel 22 has an axially extending raised portion 46 curvilinearly contoured to facilitate linear contact with the core of a roll of web material mounted thereon. The mandrel 22 has the shape of a modified elliptic cylinder with a pair of parallel axially extending contact lines 30 and 32. As such, the mandrel comprises a plurality of pairs of contact lines with a first pair of supports providing support when the roll of web material is rotated in one direction and a second pair of supports providing support when the roll of web material is rotated in a second, opposite direction. This construction creates a 2-point contact with the roll core to minimize roll wobble, and minimizes overall friction, resulting in smoother operation. Preferably the mandrel 22 is removably or rotatably connected to inner housing piece 18 so that it can be oriented to properly support a roll of web material as the dispenser 10 is moved from one wall 24 to the opposite wall.

In other embodiments the present invention may be configured to accommodate multiple rolls of web material such that it may be possible to automatically switch from one roll to the next. In other words, the present invention is not limited to the dispensing of a single roll of web material, a jumbo roll of web material or the particular configuration of the housing as shown in FIGS. 1-8. In fact, in alternative embodiments of the present invention, rolls are maintained in the dispenser housing one above the other o, one behind the other, arrayed around a wheel like cars on a ferris wheel or in stepped or side-by-side relation. By making mounting block 14 hollow and communicating the hollow portion (not shown) into the space defined by housing 12, additional storage or staging space for one or more reserve rolls of web material can be created more readily facilitating stepped or side-by-side staging of rolls.

The present invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter disclosed herein.

The invention claimed is:

1. A web dispenser configured to be mounted to an upright member extending in a vertical plane, the web dispenser comprising:

a housing maintaining at least one roll of web material therein and configured to be mounted to the upright member;

a discharge opening formed in the housing through which web material may be dispensed from the housing, and wherein the housing is constructed such that the discharge opening is angled away from the upright member at an acute angle in a substantially horizontal plane that is substantially perpendicular to the vertical plane of the upright member.

2. A web dispenser according to claim 1 further comprising a mandrel mounted in the housing and configured to hold a roll of web material in a manner that allows the roll of web material to rotate as web material is dispensed through the discharge opening.

3. A web dispenser according to claim 1, wherein said acute angle is between about 5 and 85 degrees.

4. A web dispenser according to claim 3, wherein said acute angle is between about 6 and 45 degrees.

5. A web dispenser according to claim 4, wherein said acute angle is between about 10 and 15 degrees.

6. A web dispenser according to claim 1 further comprising a mounting block connected between the upright member and the housing, wherein the mounting block has a wedge-shaped member that angles the housing relative to the upright member.

7. A web dispenser according to claim 6, wherein said housing comprises an inner housing piece and an outer housing piece and wherein said inner housing piece is connected to said mounting block.

8. A web dispenser according to claim 6, wherein said mounting block is substantially hollow.

9. A web dispenser according to claim 6, wherein said mounting block is integral with at least a portion of said housing.

* * * * *